United States Patent [19]

Flockenhaus et al.

[11] 4,282,068

[45] Aug. 4, 1981

[54] APPARATUS FOR THE TRANSFER AND QUENCHING OF COKE

[75] Inventors: Claus Flockenhaus; Manfred Galow, both of Essen; Joachim F. Meckel, Heiligenhaus; Horst G. Joseph, Essen, all of Fed. Rep. of Germany

[73] Assignee: Didier Engineering GmbH, Fed. Rep. of Germany

[21] Appl. No.: 108,008

[22] Filed: Dec. 28, 1979

[30] Foreign Application Priority Data

Jan. 2, 1979 [DE] Fed. Rep. of Germany ..... 2900079

[51] Int. Cl.[3] ..... C10B 39/04; C10B 39/08; C10B 45/00

[52] U.S. Cl. ..... 202/227; 201/39; 202/263

[58] Field of Search ..... 201/39, 41; 202/227, 202/263

[56] References Cited

U.S. PATENT DOCUMENTS

| | | | |
|---|---|---|---|
| 3,869,352 | 3/1975 | Allen et al. | 202/227 |
| 3,930,961 | 1/1976 | Sustarsic et al. | 202/227 |
| 3,966,563 | 6/1976 | Armour et al. | 201/39 X |
| 4,113,569 | 9/1978 | Mahar | 201/39 |
| 4,141,796 | 2/1979 | Clark et al. | 202/263 |
| 4,147,594 | 4/1979 | Cain et al. | 202/227 X |
| 4,196,054 | 4/1980 | Becker, Jr. et al. | 202/227 |
| 4,201,627 | 5/1980 | Chuss et al. | 201/41 X |

FOREIGN PATENT DOCUMENTS

| | | | |
|---|---|---|---|
| 2407689 | 8/1975 | Fed. Rep. of Germany | 201/39 |

*Primary Examiner*—Frank W. Lutter
*Assistant Examiner*—Roger F. Phillips
*Attorney, Agent, or Firm*—Wood, Herron & Evans

[57] ABSTRACT

In the process of transferring coke from a coke oven chamber in a battery of coke ovens to a quenching car, the coke is quenched by a water spray from above. The resulting steam is collected in a hood located above and movable with the quenching car and is either exhausted from the hood and conveyed to a condenser or is condensed in the hood with the condensate being collected, cooled and recirculated to provide the water for the quenching and condensing sprays. The apparatus and method of this invention provides for transferring and quenching the coke without emitting harmful gases and dust to the atmosphere.

4 Claims, 4 Drawing Figures

APPARATUS FOR THE TRANSFER AND QUENCHING OF COKE

BACKGROUND OF THE INVENTION

This invention relates to the transfer of coke from a coke oven chamber to a quenching car and, more particularly, to an apparatus and method wherein the coke is quenched on its removal from the oven to prevent emission of dust particles to the atmosphere, the steam resulting from quenching of the coke being collected in a hood above the quenching car and condensed to prevent its emission to the atmosphere.

In the production of coke from coal, coal is placed in oven chambers in a battery of coke ovens where it is heated in the absence of air to convert the coal to coke. On completion of the coking process, the coke is removed from the coking oven, and the red-hot coke quickly is quenched to prevent its burning on exposure to the atmosphere. In one method of producing coke, the coke oven chamber is emptied by pushing the coke out the side of the coke oven chamber by means of a pusher ram into a coke carrying car and then into a quenching car. The quenching car is then moved to a quenching tower where the red-hot coke is sprayed with water to cool it. The steam resulting from the quenching operation is generally vented to the atmosphere. During the transfer process and particularly during removal of the coke from the coke oven chamber, a considerable amount of dust is loosened from the coke as it falls into the quenching car. Because of the high temperature of the red-hot coke and consequently the heat radiating from the surface, the dust is driven upward into the atmosphere to be distributed over a large surrounding area. In one known process and apparatus for the transfer of coke from the coke oven chamber, these undesired emissions are suppressed by the arrangement of a hood on the outside of the coke carrying car above the quenching car which travels with the quenching car as it moves along the coke oven battery. Water spray nozzles are located in the hood for spraying the coke in the quenching car. The water spray cools the outer surface of the coke in the quenching car thereby greatly reducing the heat radiation from the coke. With this apparatus, the principal cause of heavy emissions to the atmosphere in the coking process is eliminated. However, this process and apparatus has a disadvantage in that the steam generated from the quenching of the coke in the quenching car accumulates under the hood and comes out from below the hood carrying dust emissions with it.

SUMMARY OF THE INVENTION

It is among the principal objects of this invention to provide an apparatus and method for the transfer of coke from a coke oven chamber to a quenching car wherein the emission to the atmosphere of dust and the steam resulting from quenching of the coke is eliminated.

To this end, the apparatus and method of the present invention employs the hood of the prior art over the quenching car, the hood being movable with the quenching car as it moves along the coke oven battery, with the improvement of a system for exhausting the dust-ladened steam from the quenching accumulated under the hood to eliminate its emission to the atmosphere. It has been found according to the apparatus and method of the present invention that satisfactory cooling of the surface of the red-hot coke in the quenching car can be achieved to prevent dust emissions from the transfer process without releasing steam containing dust particles to the atmosphere and, in addition, that complete quenching of the coke can now take place directly in the quenching car under the hood. Through partial quenching of the coke in the quenching car, a substantial reduction in the surface temperature of the upper layer of the coke is achieved to reduce the updraft which normally takes place because of heat radiating from the surface of the coke. As a result, the quenching car can then travel to the quenching tower without large amounts of dust being emitted. With complete quenching of the coke in the quenching car, the coke is cooled to a temperature of about 150° to 200° C. such that it can be transferred directly to the coke screening operation. This eliminates the need for a quenching tower.

In accordance with the principles of the present invention, the steam generated in the hood over the quenching car as a result of the quenching operation is exhausted from the hood by suitable exhaust means such as fans where it may be advantageously conveyed to a separate, stationary condensation unit. In this condensation unit, the steam is condensed to water which may be recirculated as a quenching spray water. Simultaneously, the dust particles in the steam are precipitated out and can be drawn off in a water accumulating basin as sludge. A minor amount of the steam/air mixture may be purified and discharged into the atmosphere from the condensation unit without harm to the environment.

In one presently preferred form of the invention, a conduit extends along the coke oven battery and feeds the condensation unit. The hood over the quenching car is connected by means of an interconnecting shaft to this conduit by suitable means permitting movement of the hood and the interconnecting shaft with the quenching car while continuously feeding into the conduit. With this apparatus, the steam exhausted from the hood can be fed to the stationary condensation unit with little additional structure being involved.

In another embodiment of the invention, the steam generated from quenching of the coke may be simply condensed within the hood itself with the condensate being collected, cooled, and recirculated to the hood as quenching and/or condensing liquid.

In the practice of the method of the present invention, the coke in the quenching car is quenched by a water spray from nozzles located in the lower portion of the hood which are directed diagonally downward toward the coke in the quenching car. This orientation of the spray results in an even distribution of the quenching water even at the lower layers of the coke with the result that the steam rising through the coke from the lower layers forcibly cools the coke layers lying above. Preferably, relatively coarse water jets are employed to prevent the rising steam from carrying off the drops of water before reaching the coke in the quenching car. In addition, the method of the present invention contemplates the introduction of the water spray at a relatively low rate initially to avoid the generation of excessively large amounts of steam due to the high temperature of the coke after which the water flow is steadily increased until the end of the quenching process. This permits control of the volumes of steam generated in the quenching process.

Other objects and advantages of the present invention will become apparent from the following detailed description of the invention, reference being had to the accompanying drawings.

DETAILED DESCRIPTION OF THE INVENTION

Figure 1A:
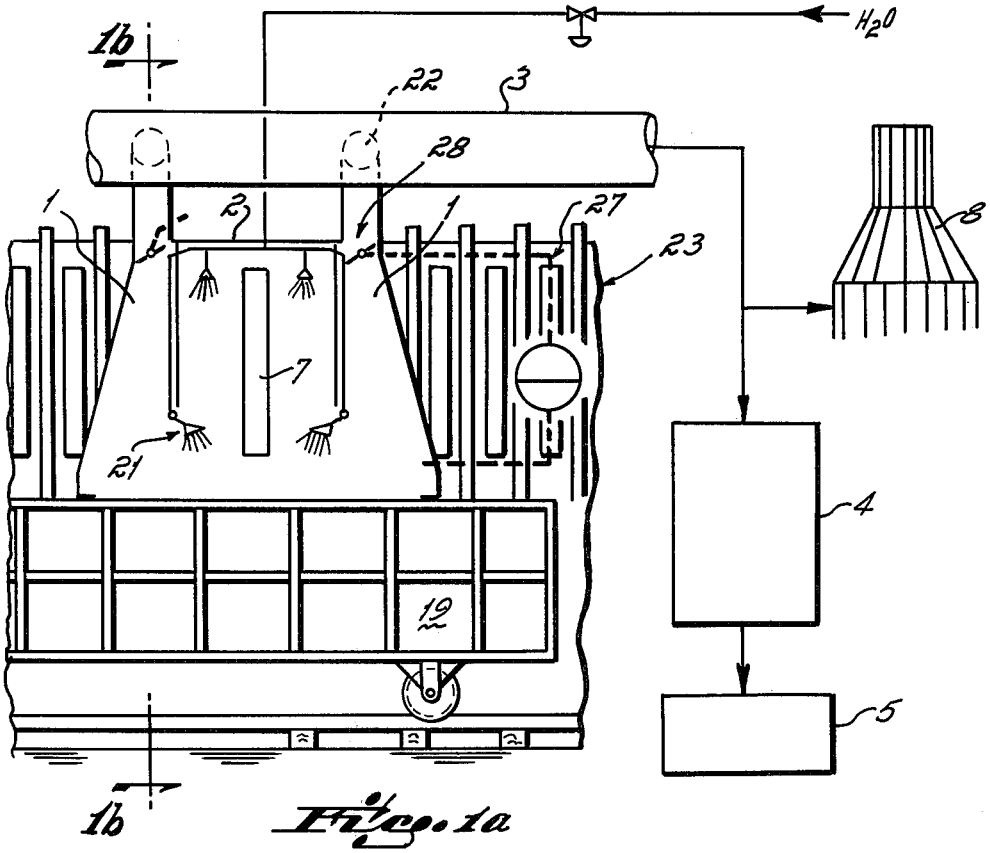
FIG. 1*a* is a schematic illustration of one embodiment of the invention.
Figure 1B:
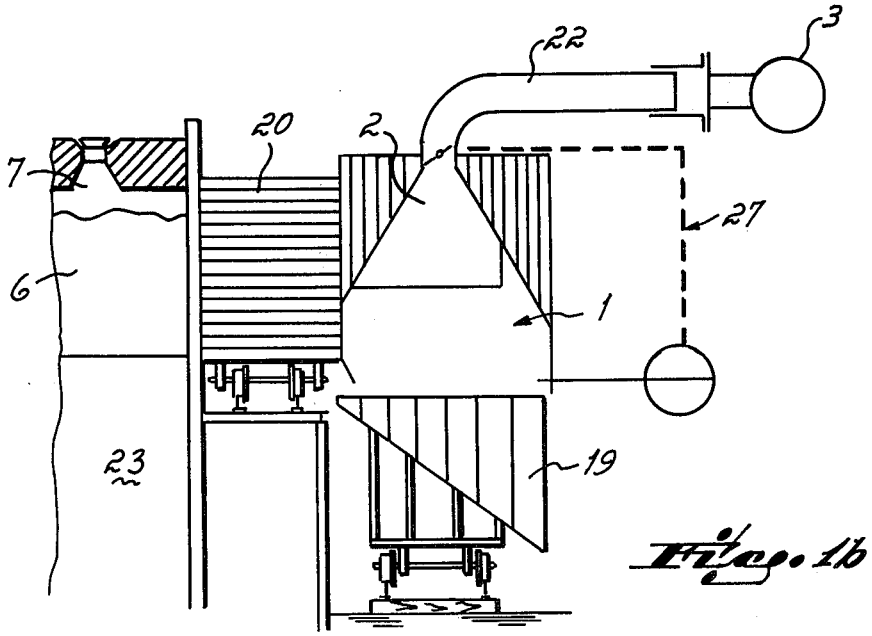
FIG. 1*b* is a view taken along lines 1*b*—1*b* of FIG. 1*a*.

The red-hot coke 6 contained in a coke oven chamber 7 is removed by pressing it out the side of the coke oven chamber 7 by means of a pusher ram (not shown). The coke 6 passes through a coke cake carrying car 20 and falls into a quenching car 19. The quenching car 19 is movable on tracks along the coke oven battery 23. In accordance with the embodiment of the invention shown in FIGS. 1*a* and 1*b*, a hood 1 is placed on the outside of the coke cake carrying car 20 which can travel with the car 20 into a position over the quenching car 19 moving along the battery 23 of coke ovens. Accordingly, the hood 1 is located in position above the quenching car 19 whenever coke is transferred from a coking oven 7 to the quenching car 19.

The hood 1 has a vertical shaft 2 to which shafts 22 are connected. The shafts 22 in turn are connected to a conduit 3 running along the battery of coke ovens 23. Dampers 28 are located in the shafts 22 to control the pressure in the hood, as hereinafter described. The conduit 3 discharges either into a stationary condensation unit 4 or into a quenching tower 8. The condensation unit 4 is in turn connected to a water collection tank 5 for collecting the condensate from the unit 4.

When the coke is passed out of the coking oven 7 and transferred into the quenching car 19, the coke is sprayed with water from nozzles 21 located in the hood 1. The nozzles are preferably located in the lower portion of the hood 1. The water spray quenches the upper surface of the coke to thereby lower its temperature to reduce the heat radiation therefrom and consequent carrying of undesirable dust particles into the atmosphere. The steam resulting from the water quench rises into the hood in part carrying dust particles with it. The steam in the hood is exhausted from the hood through the shaft 2 to the lines 22 and the collection conduit 3 and fed either to a cooling tower 8 or the condensation unit 4. In this manner, emission to the atmosphere of steam and the dust particles carried by the steam is prevented even when considerable amounts of water are employed for the complete quenching of the coke in the quenching car 19. When the steam is fed to the condensation unit 4, the precipitated dust particles can be drawn off as sludge. A small amount of the steam and air mixture can be purified and discharged into the atmosphere from the condensation unit, if desired, wi-thot undesirable effects on the environment.

Through means of a pressure regulator 27, a pressure of about 0 meter water column is maintained in the lower portion of the hood so that steam cannot leave the hood and, in addition, outside air cannot enter the hood which would interfere with the condensation of the steam in the hood in that particular embodiment.

Figure 2A:
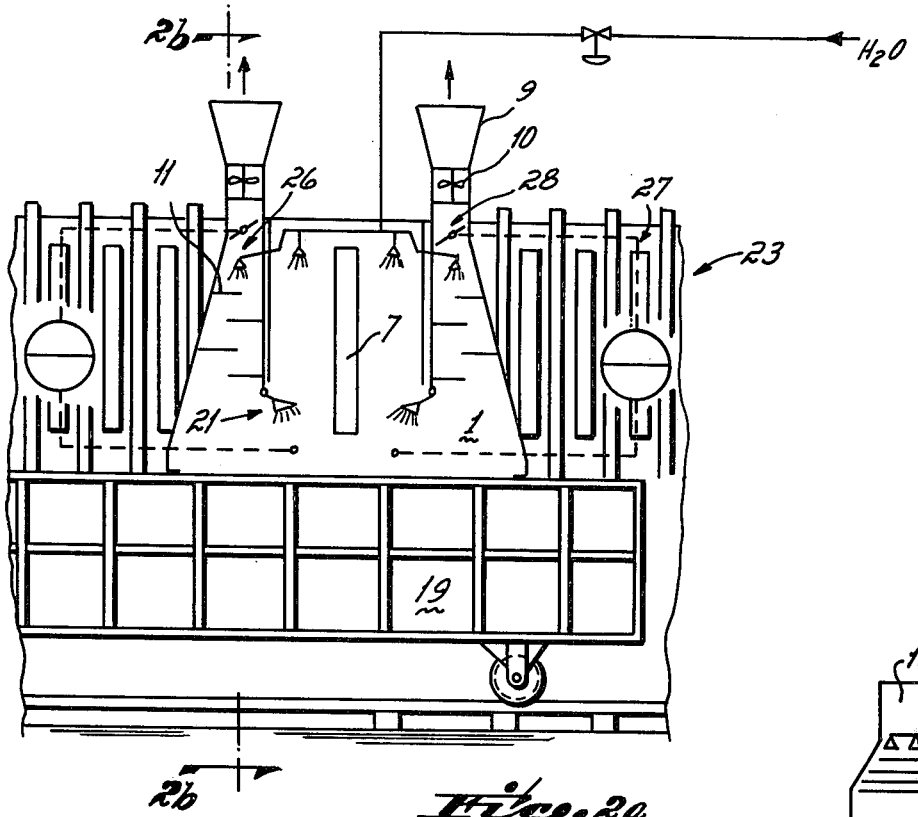
FIG. 2*a* is a schematic illustration of another embodiment of the invention.
Figure 2B:
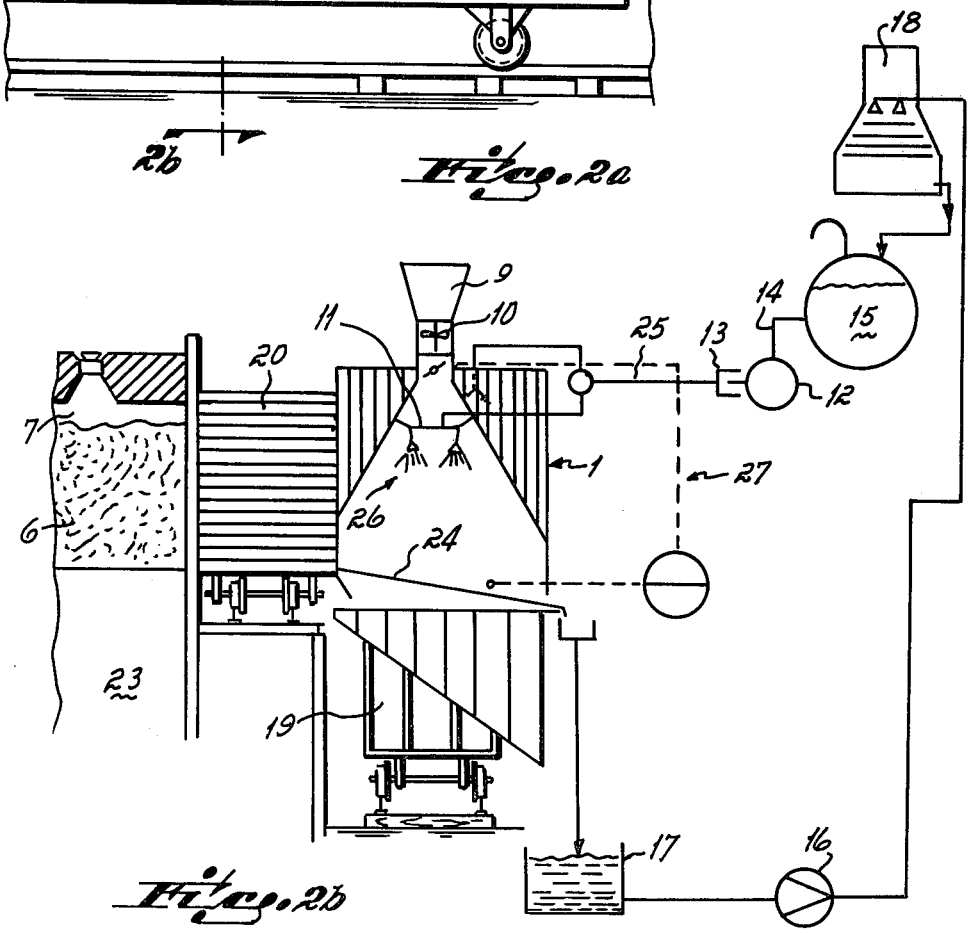
FIG. 2*b* is a view taken along lines 2*b*—2*b* of FIG. 2*a*.

Referring now to FIGS. 2*a* and 2*b*, in an alternative embodiment of the invention, chambers 11 are provided in the hood 1 for condensing the steam in the hood by means of condensation water fed through nozzles 26. Any uncondensed steam is exhausted out of the hood with the aid of a fan 10 through vertical shafts 9 connected to the chambers 11. Dampers 28 are likewise provided and cooperate with the pressure regulator 27 to maintain a pressure in the lower zone of the hood 1 of about 0 meter water column.

Referring to FIG. 2*b*, the steam condensate and the condensation water accumulate at the bottom 24 of the hood 1 and are transferred to a quenching water basin 17. From there, the accumulated water can be continuously fed by means of a pump 16 to a cooling tower 18. From there the water is accumulated in an elevated water tank 15. The water tank 15 automatically supplies the nozzles 21 and 26 through the line 14, a distributor line 12, a coupling 13, and a connection line 25 to provide the quenching water spray and condensation spray in a closed recirculation loop. In this embodiment, only the harmless residual steam vapors are exhausted from the hood while the principal portion of the steam is condensed in the hood and recirculated. There are no harmful effects on the environment through venting of the residual steam emissions to the environment.

Although the invention has been described in terms of certain preferred embodiments, it will be apparent to those skilled in the art that other forms may be adopted within the scope of the invention.

We claim:

1. In a coke quenching system, the combination comprising a coke quenching car for receiving hot coke from a coke oven and transferring it from the coke oven, a hood located in close proximity above the quenching car, means for moving the hood independently of but with the quenching car, the hood including in the interior thereof means for spraying the coke and the quenching car with water, and conduit means communicating with the movable hood to exhaust the steam resulting from quenching of the coke from inside the hood and conduct the steam to a stationary treating station without venting of the steam to the atmosphere there between.

2. The apparatus of claim 1 further comprising a condenser operable to condense the steam from inside the hood, said conduit means connecting said hood to said condenser.

3. The apparatus of claim 1 wherein said hood includes exhaust shafts communicating with the interior of the hood and wherein the conduit means comprises a collection conduit extending along the battery of coke ovens and duct means connecting said exhaust shafts to said collection conduit.

4. The apparatus of claim 1 wherein said means for spraying the coke in the quenching car with water comprises water spray nozzles located in the lower portion of the hood, said nozzles being inclined diagonally downwardly toward the coke in the quenching car.

* * * * *